US006235080B1

(12) United States Patent
Shin et al.

(10) Patent No.: US 6,235,080 B1
(45) Date of Patent: May 22, 2001

(54) CHARGING DEVICE FOR DIRECTLY CHARGING REDUCED FINE IRON ORE INTO MELTER-GASIFIER

(75) Inventors: Myoung Kyun Shin; Sang Hoon Joo, both of Kyungsangbook-do (KR)

(73) Assignees: Pohang Iron & Steel Co. Ltd.; Research Institute of Industrial Science & Technology, both of Kyungsangbook-do (KR); Voest-Alpine Industrieanlagendau GmbH, Linz (AT)

( * ) Notice: Subject to any disclaimer, the term of this patent is extended or adjusted under 35 U.S.C. 154(b) by 0 days.

(21) Appl. No.: 09/367,660

(22) PCT Filed: Dec. 18, 1998

(86) PCT No.: PCT/KR98/00437

§ 371 Date: Aug. 20, 1999

§ 102(e) Date: Aug. 20, 1999

(87) PCT Pub. No.: WO99/32667

PCT Pub. Date: Jul. 1, 1999

(30) Foreign Application Priority Data

Dec. 22, 1997 (KR) ..... 97-71701

(51) Int. Cl.[7] ..... C21B 11/00
(52) U.S. Cl. ..... 75/445; 266/172
(58) Field of Search ..... 266/168, 176, 266/172; 75/445, 444, 446

(56) References Cited

U.S. PATENT DOCUMENTS

| | | | | |
|---|---|---|---|---|
| 4,806,154 | | 2/1989 | Hauk | 75/10.19 |
| 4,978,387 | | 12/1990 | Kepplinger | 75/445 |
| 5,229,064 | | 7/1993 | Kanetsuna et al. | 266/172 |
| 5,534,046 | * | 7/1996 | Kepplinger et al. | 75/444 |
| 5,785,733 | * | 7/1998 | Lee et al. | 266/172 |

FOREIGN PATENT DOCUMENTS

| | | |
|---|---|---|
| 403056 | 12/1997 | (AT) . |
| 0217331 | 9/1986 | (EP) . |
| 0368835 | 10/1989 | (EP) . |

* cited by examiner

*Primary Examiner*—Scott Kastler

(57) ABSTRACT

A device is disclosed for directly charging raw material into a melter-gasifier in a molten iron manufacturing facility using coal and fine iron ore. The elutriation of fine dusts is inhibited while directly charging coal and reduced fines into the melter-gasifier. The direct charging device is applied to a fluidized bed type final reducing furnace and has a plurality of discharging outlets for discharging the fines. The melter-gasifier receives lump coal to form a coal packed bed within it and receives the reduced fine iron ore from the final reducing furnace. The direct charging device includes a plurality of charging inlets formed on the side wall of the melter-gasifier connected by conduits to the discharging outlets of the final reducing furnace whereby reduced fine iron ore is continuously charged from the final reducing furnace to the coal packed bed of the melter-gasifier.

14 Claims, 3 Drawing Sheets

CHARGING DEVICE FOR DIRECTLY CHARGING REDUCED FINE IRON ORE INTO MELTER-GASIFIER

FIELD OF THE INVENTION

The present invention relates to a device in which a high temperature reduced fine iron ore can be directly charged into a melter-gasifier in a molten iron manufacturing process using general coal and a fine iron ore. More specifically, the present invention relates to a device which is capable of directly charging a high temperature reduced fine iron ore into a coal packed bed type melter-gasifier while inhibiting elutriation loss, with a high temperature gas stream being formed within the melter-gasifier.

BACKGROUND OF THE INVENTION

Generally, in the blast furnace method which forms the main trend of the current molten iron manufacturing process, the raw material has to have a certain strength and has to have a particle size to ensure gas permeability. Further, coke is used as the carbon source for providing a fuel and a reducing agent. As the raw iron ore, sintered agglomerates are used. Accordingly, the currently used blast furnace has a coke manufacturing facility and an iron ore sintering facility as the auxiliary facilities. The auxiliary facilities require an enormous expenditure, and bring environmental problems. The environmental problems require an investment in anti-pollution facilities, with the result that the investments in the facilities are increased. Therefore, the competitiveness of the blast furnace is speedily faded.

In efforts for coping with this situation, research and development are being carried out to replace the coke with general coal, and to replace the iron ore agglomerates with direct fine iron ore which occupies more than 80% of the total world production.

A molten iron manufacturing facility which directly uses general coal and fine iron ore is disclosed in Austrian Patent Application No. AT2096/92.

This facility includes 3-stage fluidized bed type furnaces including a pre-heating furnace, pre-reducing furnaces and a final reducing furnace, and a melter-gasifier having a coal packed bed within it. In the manufacturing method using this molten iron manufacturing facility, a normal temperature fine iron ore is continuously charged into an uppermost reaction chamber (a pre-heater) to pass through the 3-stage fluidized bed type furnaces so as to be contacted with a high temperature reducing gas supplied from the melter-gasifier. During this process, the temperature of the fine iron ore is raised and its reduction is realized by more than 90%. The reduced fine iron ore is continuously charged into the melter-gasifier in which the coal packed bed is formed so as to be melted within the coal packed bed. Thus a molten iron is manufactured and discharged to the outside.

Meanwhile, a general lump coal is continuously charged into the top of the melter-gasifier to form a coal packed bed of a certain height. Further, oxygen is injected through a plurality of tuyere holes which are formed on a lower portion of the outer wall of the melter-gasifier. Thus the coal of the coal packed bed is burned and the combustion gas rises to form a stream of a high temperature reducing gas so as to be supplied to the three pre-reducing furnaces.

Meanwhile, within the melter-gasifier, the high temperature gas stream has a high velocity and, therefore, a large amount of fine dusts of the fine iron ore is inclined to be elutriated or carried out of the furnaces. In order to prevent this phenomenon, a large space is provided above the coal packed bed. In this manner, the elutriation of the fine dusts is maximally inhibited. However, the average flow velocity within the mentioned space is about 0.5 m/sec. Therefore, it is inevitable that the high temperature fine iron ore having a size of 100 $\mu$m or less and the coal dusts of 400 $\mu$m or less are elutriated to the outside of the furnace. Particularly, considering the particle size distribution of the high temperature fine iron ore, the particles of 100 $\mu$m or less occupy 30–35 wt. %. Thus, a large amount of the reduced fine iron ore is elutriated out of the furnace. Accordingly, a high iron loss is caused and, therefore, the yield and productivity of this molten iron manufacturing process are greatly lowered.

SUMMARY OF THE INVENTION

The present invention is intended to overcome or reduce one or the above described disadvantages of the conventional techniques.

Therefore, it is an object of the present invention to provide a device for directly charging the raw material into a melter-gasifier in a molten iron manufacturing facility directly using the general coal and a fine iron ore, in which elutriation of the fine dusts is maximally inhibited while directly charging the general coal and a fine iron ore into the melter-gasifier.

In achieving the above object, a direct charging device is applied to the molten iron manufacturing apparatus according to the present invention and includes a fluidized bed type final reducing furnace for finally reducing a fine iron ore, and having a plurality of reduced fine iron ore discharging outlets for discharging a reduced fine iron ore to an outside of the furnace; and a melter-gasifier for receiving a general lump coal to form a coal packed bed within it, to manufacture a molten iron by receiving the reduced fine iron ore from the fluidized bed type final reducing furnace.

The direct charging device includes a plurality of reduced fine iron ore charging inlets formed on a side wall of the melter-gasifier having the coal packed bed within it and a plurality of fine reduced iron ore charging conduits for connecting reduced fine iron ore discharging outlets of the fluidized bed type final reducing furnace to the reduced fine iron ore charging inlets to carry a reduced fine iron ore. The reduced fine iron ore is continuously charged from the fluidized bed type final reducing furnace into the coal packed bed of the melter-gasifier.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

Figure 1:
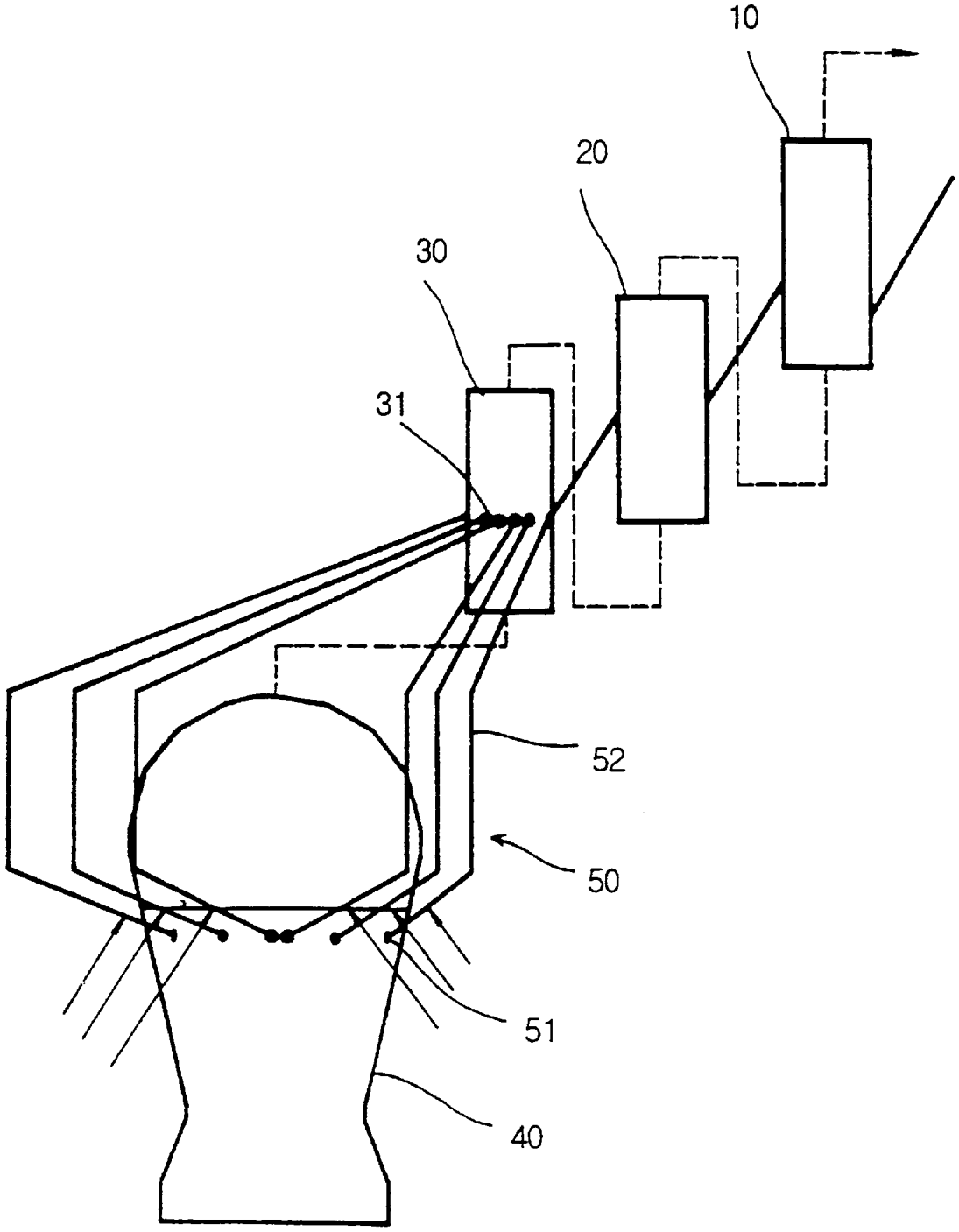
FIG. 1 schematically illustrates the device for directly charging the reduced fine iron ore into the melter-gasifier according to the present invention.
Figure 2:
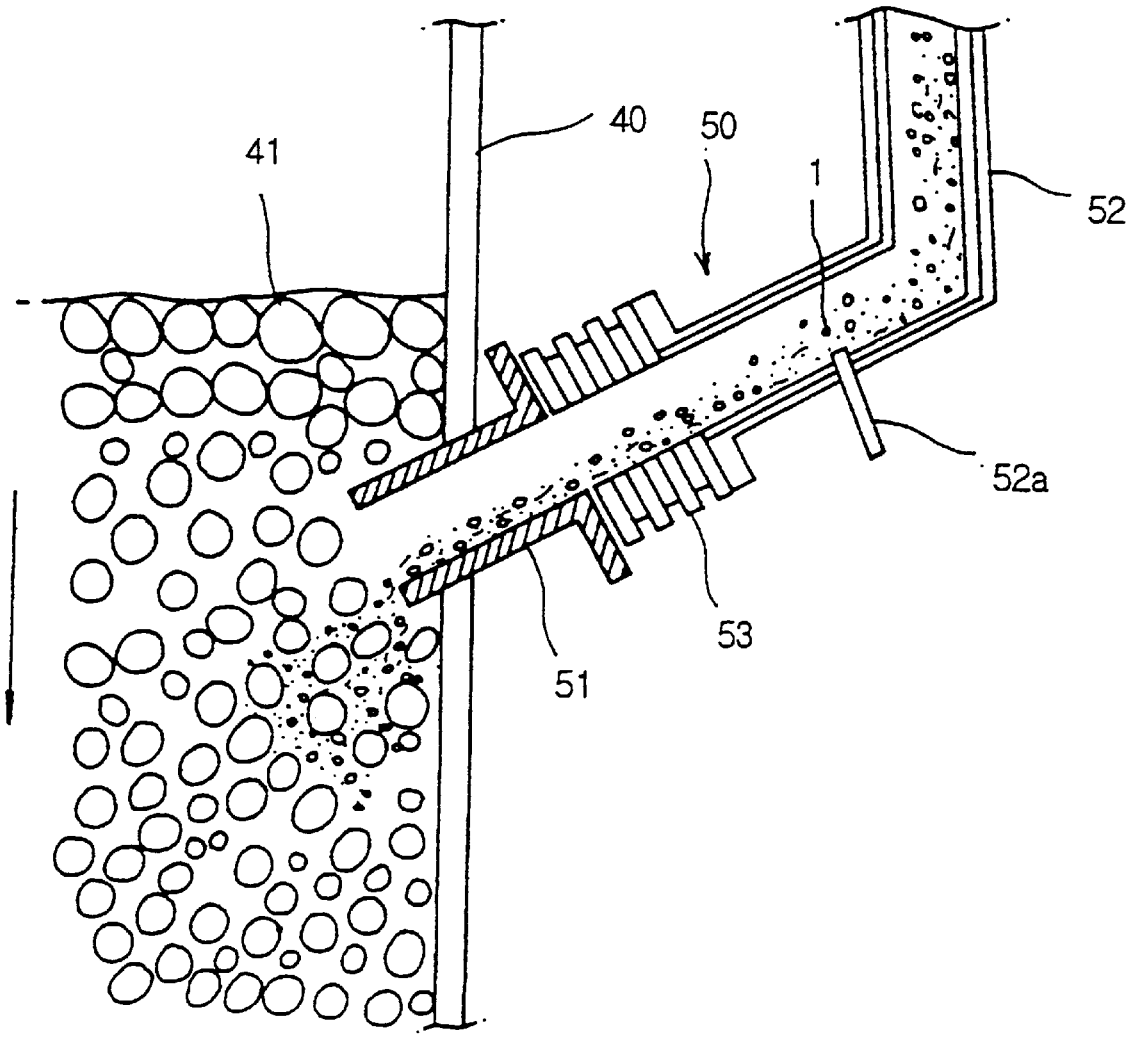
FIG. 2 is an enlarged illustration of a portion of the device for directly charging the reduced fine iron ore into the melter-gasifier according to the present invention.

As shown in FIGS. 1 and 2, a direct charging device 50 for directly charging a reduced fine iron ore into a melter-gasifier 40 according to the present invention is applied to a molten iron manufacturing apparatus. The apparatus includes a fluidized bed type final reducing furnace 30 for finally reducing a fine iron ore having a plurality of reduced fine iron ore discharging outlets 31 for discharging a reduced fine iron ore to the outside of the furnace 30. The melter-gasifier 40 receives general lump coal to form a coal packed bed 41 within it to manufacture a molten iron by receiving the reduced fine iron ore from the fluidized bed type final reducing furnace 30.

FIG. 1 illustrates a molten iron manufacturing apparatus which includes: a fluidized bed type pre-heating furnace 10 for drying and pre-heating fine iron ore; a fluidized bed type pre-reducing furnace 20 for pre-reducing the dried and pre-heated fine iron ore; a fluidized bed type final reducing furnace 30 for finally reducing the pre-reduced fine iron ore, and a melter-gasifier 40 for manufacturing the finally reduced fine iron ore into a molten iron. However, the application of the direct charging device 50 for directly charging the reduced fine iron ore into the melter-gasifier 40 is not limited to the molten iron manufacturing apparatus of FIG. 1. For example, it can be applied to a molten iron manufacturing apparatus having 2-stage fluidized bed type furnaces.

As shown in FIGS. 1 and 2, the direct charging device 50 includes a plurality of reduced fine iron ore charging inlets 51 formed on the side wall of the melter-gasifier 40 having the coal packed bed 41 within it, and a plurality of reduced fine iron ore charging conduits 52 are provided for connecting the reduced fine iron ore discharging outlets 31 of the fluidized bed type final reducing furnace 30 to the reduced fine iron ore charging inlets 51 to carry the reduced fine iron ore.

The number of the reduced fine iron ore charging inlets 51 should be preferably 4 or more, more preferably 6–8, so that a reduced fine iron ore 1 can be substantially uniformly dispersed within the coal packed bed 41.

If the diameter of the melter-gasifier 40 where the coal packed bed 41 is formed is about 7.3 m, the reduced fine iron ore charging inlets 51 should be provided preferably in the number of 6–8.

Figure 3:
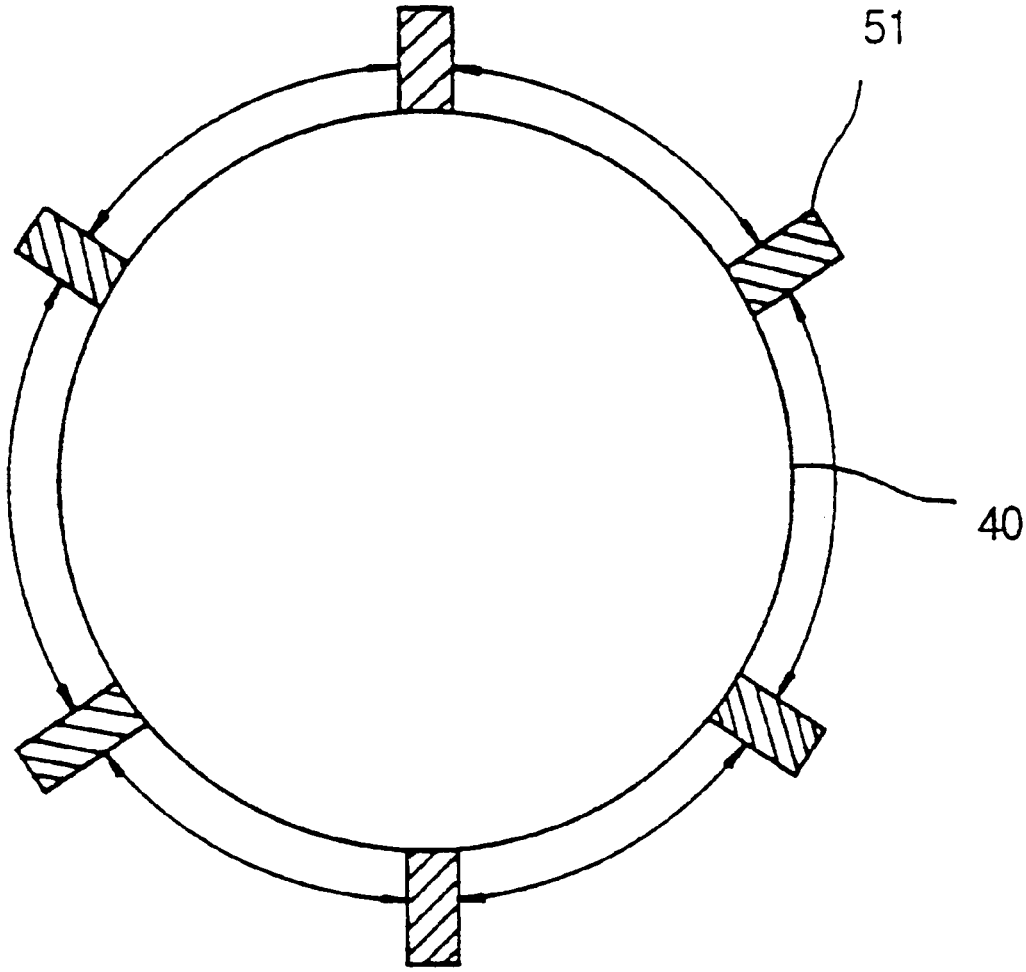
FIG. 3 illustrates an example of the layout of the device for directly charging the reduced fine iron ore into the melter-gasifier according to the present invention.

As shown in FIG. 3, the reduced fine iron ore charging inlets 51 are preferably formed around the circumference of the melter-gasifier 40 at certain angular intervals.

Of course, the number of the reduced fine iron ore discharging outlets 31 of the fluidized bed type final reducing furnace 30 should be equal to or more than the number of the reduced fine iron ore charging inlets 51.

The reduced fine iron ore charging inlets 51 should be formed on the side wall of the melter-gasifier 40 where the coal packed bed 41 is formed. Preferably, they should be formed on the side wall of the melter-gasifier 40 at a height equal to about 10–20% of the height (thickness) of the coal packed bed 41 below an upper surface of the coal packed bed 41. More preferably, they should be disposed at a height equal to about 15% below an upper surface of the coal packed bed 41.

In selecting the positions of the reduced fine iron ore charging inlets 51, the elutriation of the reduced fine iron ore 1 to the outside of the furnace and the dispersion of the reduced fine iron ore, within the coal packed bed 41 should be taken into account.

If the positions of the reduced fine iron ore charging inlets 51 are too high, then the reduced fine iron ore is likely to be elutriated from the furnace. If they are to low, the dispersion of the reduced fine iron ore into the coal packed bed becomes too slow.

The reduced fine iron ore charging inlets 51 should preferably protrude into the melter-gasifier 40 by a certain length. The protruding length should be preferably about 3–50% of the radius of the coal packed bed 41. If the internal temperature and the atmosphere of the melter-gasifier 40 are taken into account, the protruding length should be preferably about 3–7% of the radius of the coal packed bed, and more preferably, it should be about 5%.

If the protruding length of the reduced fine iron ore charging inlets 51 is too long, the dispersion capability of the reduced fine iron ore into the coal packed bed is lowered.

Further, the reduced fine iron ore charging inlets 51 should be inclined downward, and the inclining angle should be preferably about 20–45°.

If the inclining angle is too small, the downward flow of the reduced fine iron ore is not smooth, while if the inclining angle is too large, the dispersion capability of the reduced fine iron ore within the coal packed bed is lowered.

The reduced fine iron ore charging conduit 52 connects the reduced fine iron ore discharging outlet 31 of the fluidized bed type final reducing furnace 30 to the reduced fine iron ore charging inlet 51 to carry the reduced fine iron ore. The reduced fine iron ore charging conduit 52 is connected to the reduced fine iron ore charging inlet 51 in such a manner that the leading end of the charging conduit 52 and the rear end of the reduced iron charging inlet 51 are each provided with a flange, and a contractible/extendable tube 53 is installed between the two flanges, thereby connecting the conduit 52 and the inlet 51 together.

The reduced fine iron ore charging conduit 52 is preferably provided with a nitrogen injecting pipe 52*a*, so that the reduced fine iron ore can be smoothly carried down.

Now the action of the device of the present invention will be described.

The reduced fine iron ore 1 is discharged continuously from the plurality of the reduced fine iron ore discharging outlets 31 of the fluidized bed type final reducing furnace 30. Then the reduced fine iron ore 1 is carried down through the reduced fine iron ore charging conduits 52 by the help of gravity. Then the reduced fine iron ore 1 is continuously carried through the plurality of the reduced fine iron ore charging inlets 51 into the coal packed bed 41 to be dispersed through spaces formed between the coal particles.

The coal particles within the coal packed bed 41 continuously move downward, while the reduced fine iron ore among the coal particles also moves downward together with the coal particles of the coal packed bed. Therefore, around the leading end of the reduced fine iron ore charging inlet 51, there is continuously formed new spaces to receive the reduced fine iron ore. Therefore, the reduced fine iron ore can continuously flow downward. Meanwhile, the gas permeability around the charging inlets 51 therefore, can be aggravated due to continuous charging. Therefore, four or more of the charging inlets 51, more preferably 6–8 charging inlets 51, should be uniformly dispersedly provided.

Further, the leading end of the charging inlet 51 is disposed near to the surface of the coal packed bed 41, so that the gas permeability would be smooth. Further, the leading end of the charging inlet 51 is disposed at a height below the surface of the coal packed bed equal to about 10–20% of the total thickness of the coal packed bed 41. Further, in order to prevent aggravation of the gas permeability, the leading end of the charging inlet 51 is disposed below the surface of the coal packed bed at a height equal to about 3–50% of the radius of the coal packed bed.

Meanwhile, the reduced fine iron ore charging conduit 52 is preferably provided with a nitrogen purging or injection pipe 52*a*, so that the reduced fine iron ore can be smoothly carried. A contractible/extendable tube 53 is installed between the two flanges, thereby connecting the conduit 52 and the associated inlet 51 together. Thus the contractible/extendable tube 53 absorbs thermal stress.

Now the present invention will be described based on an actual example.

EXAMPLE

In order to evaluate the elutriation rate of the fine iron ore, a coal packed bed was used which had a superficial velocity of 0.4 m/sec and an average air space rate of 0.4. Into this coal packed bed, a fine iron ore having particle sizes of 8 mm or less were put from above. That is, the fine iron ore was put into the upper space and to the heights of 10%, 30% and 50% of the thickness of the coal packed bed respectively. In this manner, the maximum particle size among the elutriated particles was measured. In the case where the fine iron ore was put into the upper space, the maximum particle size was 100 $\mu$m. In the case where the fine iron ore was put to the height of 10%, the maximum particle size was 30 $\mu$m. In the case where the fine iron ore was put to the heights of 30% and 50%, the maximum particle size was 10 $\mu$m or less. Therefore, it could be known that the deeper the fine iron ore was put, the smaller the maximum size became. If the fine iron ore is put to a lower height, the fine iron ore particles are surrounded by more coal particles. Therefore, it can be known that the elutriation of the fine iron ore particles by the rising gas streams is significantly reduced compared with the case of putting the fine iron ore into the upper space.

According to the present invention as described above, the elutriation loss of the fine iron ore particles due to the rising gas streams is minimized, and a means for continuously feeding the pre-reduced fine iron ore into the melter-gasifier is provided. Therefore, in the manufacturing line, the loss of the iron can be greatly reduced.

What is claimed is:

1. A direct charging device for directly charging a reduced fine iron ore into a melter-gasifier applied to a molten iron manufacturing apparatus having a fluidized bed final reducing furnace for finally reducing a fine iron ore, the final reducing furnace having a plurality of reduced fine iron ore discharging outlets for discharging a reduced fine iron ore to an outside of the final reducing furnace, and a melter-gasifier receiving general lump coal to form a coal packed bed within the melter-gasifier to manufacture a molten iron by receiving reduced fine iron ore from fluidized bed final reducing furnace, the direct charging device comprising:

a plurality of reduced fine iron ore charging inlets formed around a circumference of a side wall, positioned at substantially angular intervals and inclined downwardly at an angle of about 20–45°, on the side wall of the melter-gasifier; and a plurality of reduced fine iron ore charging conduits connecting the reduced fine iron ore discharging outlets of the fluidized bed final reducing furnace to the reduced fine iron ore charging inlets, whereby reduced fine iron ore is continuously charged from the fluidized bed final reducing furnace into the coal packed bed of the melter-gasifier.

2. The direct charging device as claimed in claim 1, including at least four reduced fine iron ore charging inlets and at least four reduced fine iron ore discharging outlets.

3. The direct charging device as claimed in claim 2, wherein said melter-gasifier has a diameter of about 7.3 m and 6–8 reduced fine iron ore charging inlets and reduced fine iron ore discharging outlets are provided.

4. A method of manufacturing iron comprising the steps of:

providing a direct charging device for directly charging a reduced fine iron ore into a melter-gasifier applied to a molten iron manufacturing apparatus having a fluidized bed final reducing furnace for finally reducing a fine iron ore, the final reducing furnace having a plurality of reduced fine iron ore discharging outlets for discharging a reduced fine iron ore to an outside of the final reducing furnace, and a melter-gasifier receiving general lump coal to form a coal packed bed within the melter-gasifier to manufacture a molten iron by receiving reduced fine iron ore from fluidized bed final reducing furnace, the direct charging device comprising:

a plurality of reduced fine iron ore charging inlets formed around a circumference of a side wall, positioned at substantially angular intervals and inclined downwardly at an angle of about 20–45°, on the side wall of the melter-gasifier; and a plurality of reduced fine iron ore charging conduits connecting the reduced fine iron ore discharging outlets of the fluidized bed final reducing furnace to the reduced fine iron ore charging inlets, whereby reduced fine iron ore is continuously charged from the fluidized bed type final reducing furnace into the coal packed bed of the melter-gasifier directly charging reduced fine iron ore from a fluidized bed final reducing furnace to the direct charging device wherein the reduced fine iron ore charging inlets are disposed on a side wall of the melter-gasifier at a height of about 10–20% of a thickness of the coal packed bed below an upper surface of said coal packed bed.

5. The method as claimed in claim 4, wherein said reduced fine iron ore charging inlets are disposed on a side wall of said melter-gasifier at a height equal to about 15% of a thickness of said coal packed bed below an upper surface of said coal packed bed.

6. The method as claimed in claim 4, wherein said reduced fine iron ore charging inlets protrude from a side wall of said melter-gasifier into its interior as much as about 3–50% of a radius of said coal packed bed.

7. The method as claimed in claim 6, wherein said reduced fine iron ore charging inlets protrude from a side wall of said melter-gasifier into its interior as much as about 3–7% of a radius of said coal packed bed.

8. The method as claimed in claim 4, wherein said reduced fine iron ore charging inlets protrude from a side wall of said melter-gasifier into its interior as much as about 3–50% of a radius of said coal packed bed.

9. The method as claimed in claim 8, wherein said reduced fine iron ore charging inlets protrude from a side wall of said melter-gasifier into its interior as much as about 3–7% of a radius of said coal packed bed.

10. The method as claimed in claim 5, wherein said reduced fine iron ore charging inlets protrude from a side wall of said melter-gasifier into its interior as much as about 3–50% of a radius of said coal packed bed.

11. The method as claimed in claim 10, wherein said reduced fine iron ore charging inlets protrude from a side wall of said melter-gasifier into its interior as much as about 3–7% of a radius of said coal packed bed.

12. The direct charging device as claimed in claim 1, wherein a reduced fine iron ore charging inlet and associated reduced fine iron ore charging conduit are joined together by flanges on a leading end of said reduced fine iron ore charging conduit and a rear end of said reduced fine iron ore charging inlet, and wherein a contractible/extendable tube is located between said two flanges.

13. The direct charging device as claimed in claim 12, wherein said reduced fine iron ore charging conduit is provided with a nitrogen purging pipe to make a flow of the reduced fine iron ore smooth.

14. The direct charging device as claimed in claim 1, wherein said reduced fine iron ore charging conduit is provided with a nitrogen purging pipe to make a flow of the reduced fine iron ore smooth.

* * * * *

UNITED STATES PATENT AND TRADEMARK OFFICE

CERTIFICATE OF CORRECTION

PATENT NO. : 6,235,080 B1
DATED : May 22, 2001
INVENTOR(S) : Myoung Kyun Shin et al.

It is certified that error appears in the above-identified patent and that said Letters Patent is hereby corrected as shown below:

Column 3,
Line 21, "within it, and a" should read -- within it. A --.

Column 4,
Line 40, after "inlets 51" delete "therefore,".

Signed and Sealed this

Eleventh Day of December, 2001

*Attest:*

Nicholas P. Godici

*Attesting Officer*

NICHOLAS P. GODICI
*Acting Director of the United States Patent and Trademark Office*